US005471197A

United States Patent [19]

McCurdy et al.

[11] Patent Number: 5,471,197

[45] Date of Patent: Nov. 28, 1995

[54] TAMPER-PROOF BRACELET FOR HOME ARREST SYSTEM

[75] Inventors: Jim McCurdy, Middletown; Michael Doyle, Cincinnati; Michael McLaughlin, Dayton, all of Ohio

[73] Assignee: Cincinnati Microwave, Inc., Cincinnati, Ohio

[21] Appl. No.: 20,207

[22] Filed: Feb. 19, 1993

[51] Int. Cl.[6] ..... G08B 13/186

[52] U.S. Cl. ..... 340/573; 340/539; 340/555; 340/568; 340/693; 379/38

[58] Field of Search ..... 340/573, 568, 340/693, 539, 555; 379/38

[56] References Cited

U.S. PATENT DOCUMENTS

| | | | |
|---|---|---|---|
| 4,262,284 | 4/1981 | Stieff et al. | 340/568 |
| 4,285,146 | 8/1981 | Charles et al. | 40/665 |
| 4,370,020 | 1/1983 | Davey | 385/147 |
| 4,379,289 | 4/1983 | Peek | 340/555 |
| 4,546,345 | 10/1985 | Naito | 340/542 |
| 4,591,709 | 5/1986 | Koechner et al. | 250/221 |
| 4,593,273 | 6/1986 | Narcisse | 340/539 |
| 4,598,275 | 7/1986 | Ross et al. | 340/573 |
| 4,633,235 | 12/1986 | DeGennaro | 340/568 |
| 4,639,713 | 1/1987 | Kitagawa et al. | 340/568 |
| 4,675,656 | 6/1987 | Narcisse | 340/539 |
| 4,694,284 | 9/1987 | Leveille et al. | 340/574 |
| 4,706,689 | 11/1987 | Man | 128/903 |
| 4,747,120 | 5/1988 | Foley | 379/38 |
| 4,777,477 | 11/1988 | Watson | 340/668 |
| 4,814,751 | 3/1989 | Hawkins et al. | 340/573 |
| 4,878,045 | 10/1989 | Tanaka et al. | 340/556 |
| 4,918,432 | 4/1990 | Panley et al. | 340/573 |
| 4,920,334 | 4/1990 | De Volpi | 340/568 |
| 4,973,944 | 11/1990 | Maletta | 340/568 |
| 4,980,671 | 12/1990 | McCurdy | 340/568 |
| 5,003,292 | 3/1991 | Harding et al. | 340/568 |
| 5,014,040 | 5/1991 | Weaver et al. | 340/572 |
| 5,055,827 | 10/1991 | Philipp | 340/568 |
| 5,075,670 | 12/1991 | Bower et al. | 340/573 |
| 5,117,222 | 5/1992 | McCurdy et al. | 379/38 |
| 5,150,100 | 9/1992 | Black et al. | 340/555 |

FOREIGN PATENT DOCUMENTS

WO85/00152 1/1985 WIPO .

*Primary Examiner*—Glen Swann
*Attorney, Agent, or Firm*—Limbach & Limbach

[57] ABSTRACT

A personnel monitoring apparatus has a transmitter for transmitting a data encoded signal. A strap is provided for coupling the transmitter to a person to be monitored. An emitter is attached to the transmitter for emitting an optical signal. A detector is attached to the transmitter for detecting the optical signal. An optical fiber is incorporated with the strap for optically coupling the emitter and the detector. A comparator compares the optical signal and a reference signal, and the result of the comparison sets the value of a preselected data bit in the data encoded signal.

4 Claims, 5 Drawing Sheets

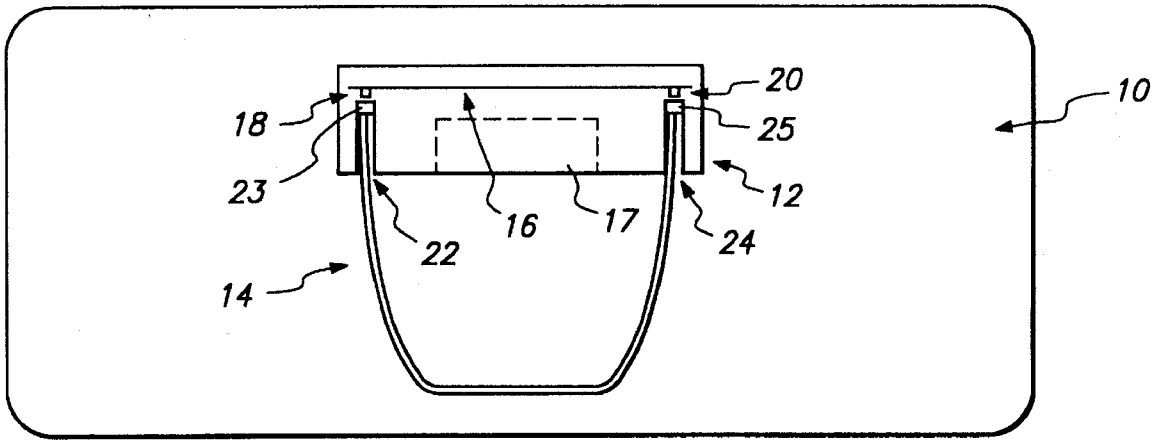
FIG. 1
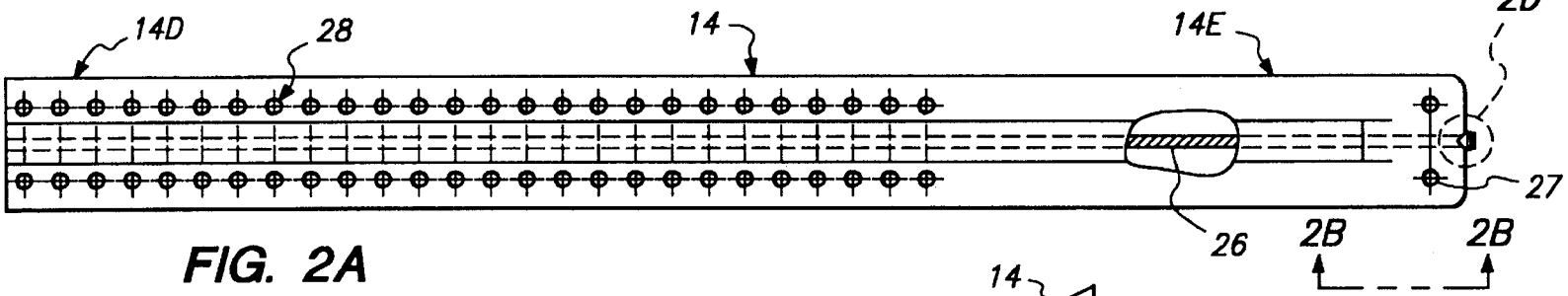
FIG. 2A
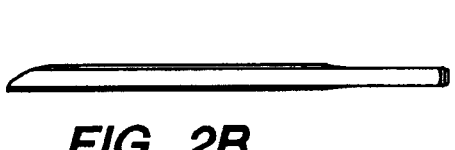
FIG. 2B
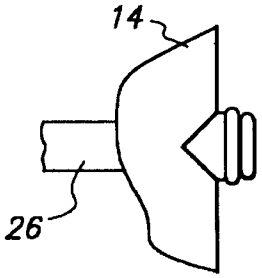
FIG. 2C
FIG. 2D

| | |
|---|---|
| FIG. 5A | FIG. 5B |
| FIG. 5C | |

MC68HC705C8FB
24C01A
LM393D
3904
BPW-34
MBT5087
SFH487-3
BSS138
1N914
REV
TURBO
TESTIN
TESTOUT
3V
TAMPER_DET
TX DATA
LED ON-OFF
ANT1
ANT2

20
40
18
VCC=VX
VCC1
PB0 PB1 PB2 PB3 PB4 PB5 PB6 PB7
PD0_RDI PD1_TDC PD2_MISC PD3_MOSI PD4_SCN PD5_NSS PD7
TCMP TCAP
PC0 PC1 PC2 PC3 PC4 PC5 PC6 PC7
PA0 PA1 PA2 PA3 PA4 PA5 PA6 PA7
OSC1 OSC2
VCC VSS VDD NIRG NRESET
VCC SCL SDA VSS A0 A1 A2
VS VR
100K 10K 33K 330K 120K 1MEG 22K 560 510 .01μ .1μ 10μ 470p

TAMPER-PROOF BRACELET FOR HOME ARREST SYSTEM

FIELD OF THE INVENTION

The present invention relates to personnel monitoring systems, and more particularly, to a tamper-proof transmitter apparatus which is utilizable in a home arrest system.

BACKGROUND OF THE INVENTION

The increase in prison population coupled with the shortage of adequate prison space has increased the interest in using personnel monitoring devices as part of a home arrest system.

Various personnel monitoring devices have been proposed in the past. For example, U.S. Pat. No. 4,973,944 discloses a proximity device which is strapped by a band to a person's leg or wrist. The device transmits encoded RF signals which are received by a receiving station. When the device is taken out of range or the band is severed, the receiving station does not receive the transmitted signals, and an alert condition is initiated. The band is made of plastic and has electrically conductive material adhered to its outer surface such that a resistive DC circuit path exists when both ends of the band are brought into contact with one another. Likewise, U.S. Pat. No. 4,980,671 discloses a transmitter secured to the body of a person by a conductive mounting strap. An electronic latch outputs a signal indicative of whether or not the strap has been broken.

These known personnel monitoring devices have the disadvantage that conductive elements are employed to maintain continuity through the strap. However, conductive elements may be effectively bypassed through the use of appropriate jumpers. Thus, one can remove the strap while bypassing the conductive element, thereby rendering the device ineffective for its intended purpose.

Fiber optic technology has been used as a substitute for conductive elements in certain theft detection devices. For example, U.S. Pat. No. 5,055,827 discloses an optical fiber attached to an appliance and connected to a control box. An alarm is activated if the detected light signal is attenuated, such as would occur if the optical fiber were bent or broken in an attempt to steal the appliance. However, no one has heretofore employed fiber optic technology in a personnel monitoring device to provide a signal indicative of a tamper condition.

According to the present invention, fiber optic technology is utilized in a personnel monitoring device to avoid the disadvantage described above.

SUMMARY OF THE INVENTION

A tamper-proof personnel monitoring apparatus is disclosed. A housing is suited for attachment to the ankle of a person by a strap. The housing contains a transmitter, an optical emitter, an optical detector, and a comparator. The transmitter transmits data encoded signals to be received by a receiver so as to verify the location of the person.

The strap has a fiber optic cable embedded therein. One end of the strap is secured to the housing so that the fiber optic cable is aligned with the emitter. The other end of the strap is secured to the housing so that the fiber optic cable is aligned with the detector. The emitter is periodically pulsed, and the detector is periodically sampled. The sampled signal is compared to a reference signal, and a preselected one of the data bits of the data encoded signal is controlled by the comparison. When the strap is bent or broken, the amount of light received by the detector is attenuated and the sampled signal drops below the reference signal, thus changing the state of the preselected bit.

BRIEF DESCRIPTION OF THE DRAWINGS

FIG. 1 is a top plan view of a tamper-proof bracelet according to the present invention and designed to be worn about the ankle of a person to be monitored.

FIGS. 2A–2C are plan views of the strap which secures the bracelet of FIG. 1 to the person's ankle.

FIG. 2D is an enlarged view of one end of the strap illustrated in FIG. 2A.

DETAILED DESCRIPTION OF THE INVENTION

Figure 4:
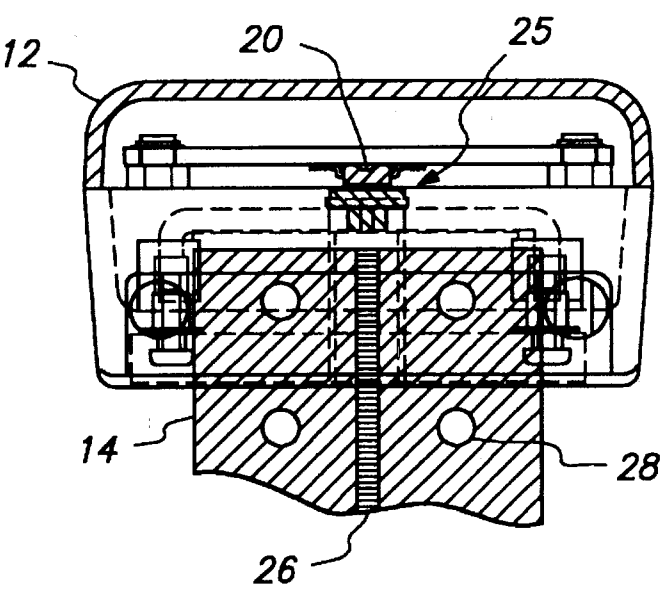
FIG. 4 is a side cross-sectional view of the transmitter housing.

The preferred embodiment of a tamper-proof bracelet 10 according to the present invention is illustrated in FIG. 1. The tamper-proof bracelet 10 is useful, for example, to secure a transmitter housing 12 to a person's ankle with strap 14 so that the location of the person may be monitored.

The housing 12 is a sealed unit made from hard plastic and measuring approximately 2.5 inches wide by 2 inches long by 1 inch thick. Slots 22, 24 are provided in the housing 12 for receiving the strap 14. Clear plastic windows 23, 25 are provided in the center of slots 22, 24, respectively. A printed circuit board 16 is mounted inside the housing 12. The circuit board 16 includes a transmitter (not shown) for transmitting signals, preferably RF signals, to a remote receiving station (not shown) according to known techniques. See, for example, U.S. Pat. No. 4,747,120. The housing 12 also has a battery compartment 17 provided therein.

The circuit board 16 also has an optical emitter 18 and an optical detector 20 mounted thereon. The optical emitter 18 is preferably a conventional light emitting diode of the type which emits infrared energy, for example, type SFH487-3. The emitter 18 is fixed in position proximate to the window 23. The optical detector 20 is preferably a conventional photo diode, for example, type BPW-34. The detector 20 is fixed in position proximate to the window 25.

Referring now to FIGS. 2A–2D, the strap 14 measures approximately 13 inches in length by 1.250 inches in width by 0.150 inches in thickness. The strap 14 is preferably a cast urethane elastomer, but may be any type of flexible plastic or rubber. Embedded within the strap 14 along its center line is a fiber optic cable 26. The preferred fiber optic cable 26 is Mitsubishi Rayon SHV 4001 or its equivalent. At one end 14E of the strap 14, a pair of holes 27 having a 0.150 inch diameter are provided for securing that end of the cable within slot 22. At the other end 14D of the cable 26, additional pairs of holes 28 are provided over some length of the cable, for example, twenty five pairs of holes are illustrated in FIG. 2, so that the length of the strap may adjusted by cutting the strap so that it fits snugly around the ankle of the person to be monitored. FIG. 2B–2C provide side and end views of the strap 14 showing dimensions of the preferred embodiment. FIG. 2D provides a detailed view of the end 14E of the strap showing a conical taper to facilitate optical alignment of the cable 26 with the emitter 18 through window 23.

In order to ensure practical application of this tamper detection scheme, the strap material must be carefully constructed to ensure that tampers cannot be falsely generated by bending or pinching the strap. Seals disposed at the ends of the strap are designed to prevent fluids from penetrating the area between the fiber optic ends and the clear plastic windows. Otherwise, the presence of fluid may block the light path and cause false tamper signals to be transmitted.

Figure 3:
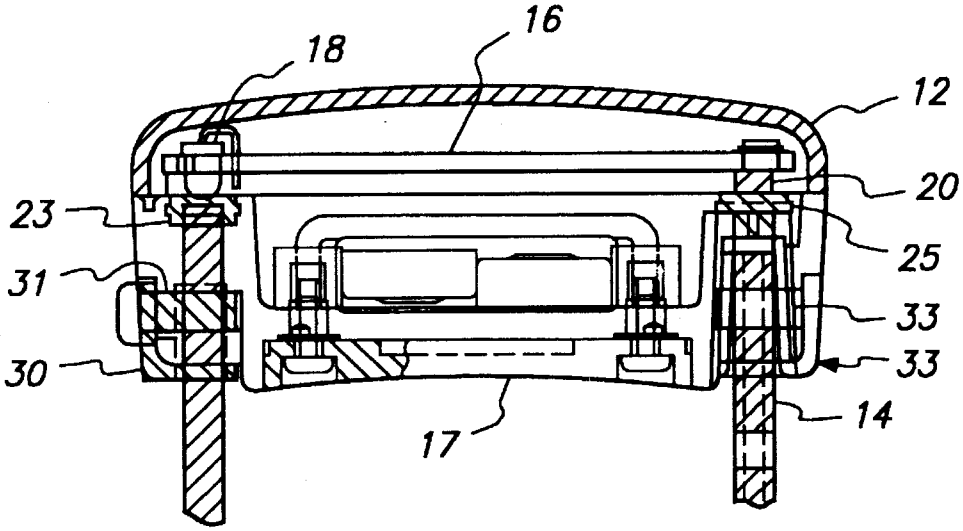
FIG. 3 is a side cross-sectional view of the transmitter housing.

FIGS. 3 and 4 show a cross-section of the transmitter housing 12 to more clearly illustrate connection of the strap 14 to the housing 12. The emitter end 14E of strap 14 may be secured into slot 22 at the time of manufacture by affixing clip 30 to the housing 12 such that pins 31 on the clip 30 insert through holes 27. The detector end 14D of the strap 14 is cut to fit, then wrapped around the person's ankle and secured in slot 24 by clip 32 such that pins 33 on clip 32 insert through holes 28.

Once the strap 14 is secured in place, an optical path is created between the optical emitter 18 and the optical detector 20 via fiber optic cable 26. The optical emitter 18 is mounted such that emitted energy will pass through the window 23 in slot 22. Infrared energy passing through the window enters the fiber optic cable 26 and passes through the cable to impinge on optical detector 20 through window 25. Thus, for normal operation, the emitter will emit a known quantity of infrared energy and the detector will detect a known quantity of infrared energy.

If the strap is cut or otherwise disconnected, the optical circuit is broken and a controller sends a tamper indication as a part of the transmitted message. The receiver (not shown), located nearby within person's home, receives the transmitted message including a tamper indication and notifies a monitoring center via a telephone line that a tamper has occurred, thus prompting fast action on the part of the monitoring service.

Figures 5A, 5B, 5C:
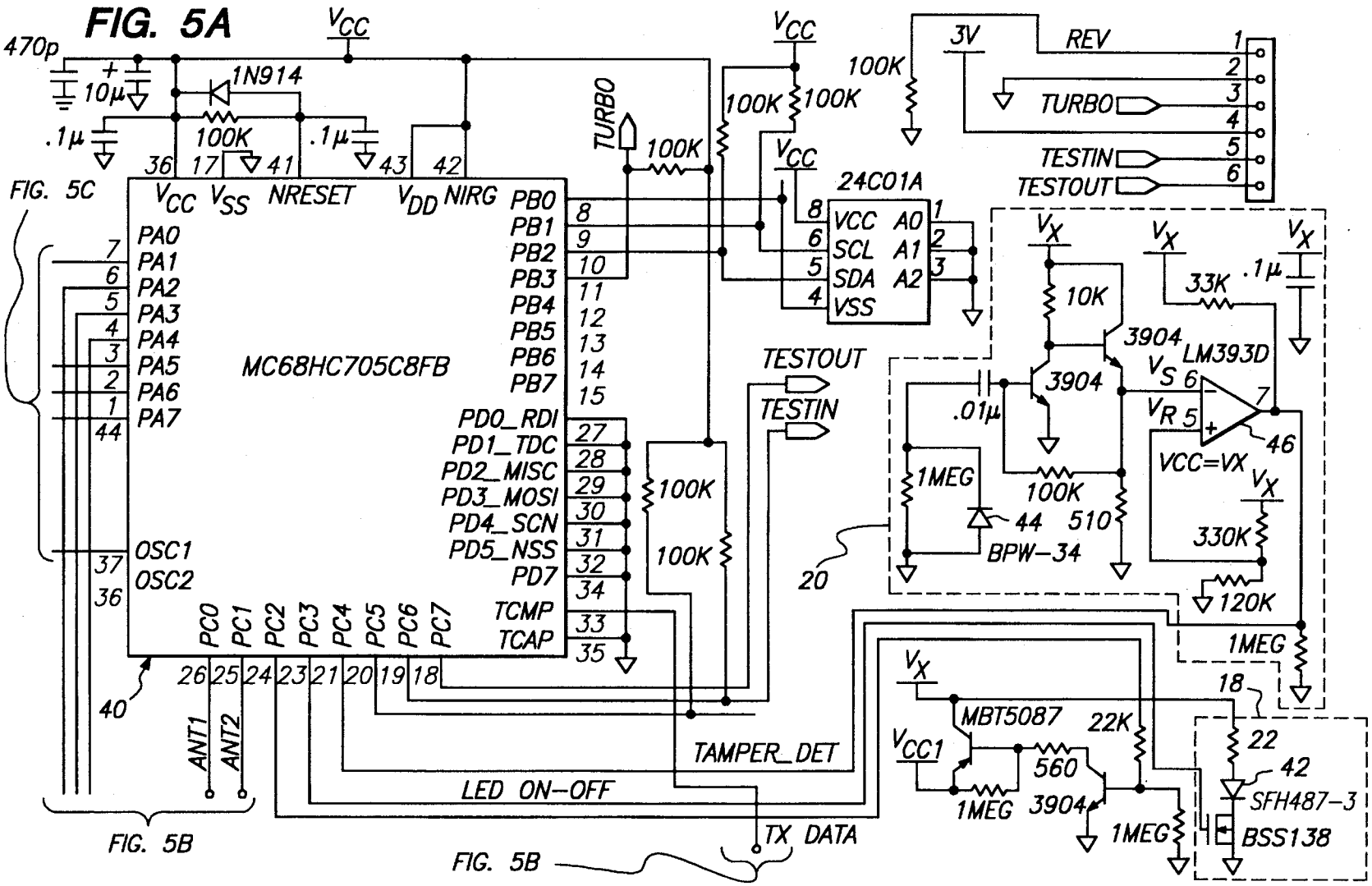
FIGS. 5A–5C are schematic diagrams of the preferred embodiment of a tamper-proof bracelet according to the present invention.
Figure 5B:
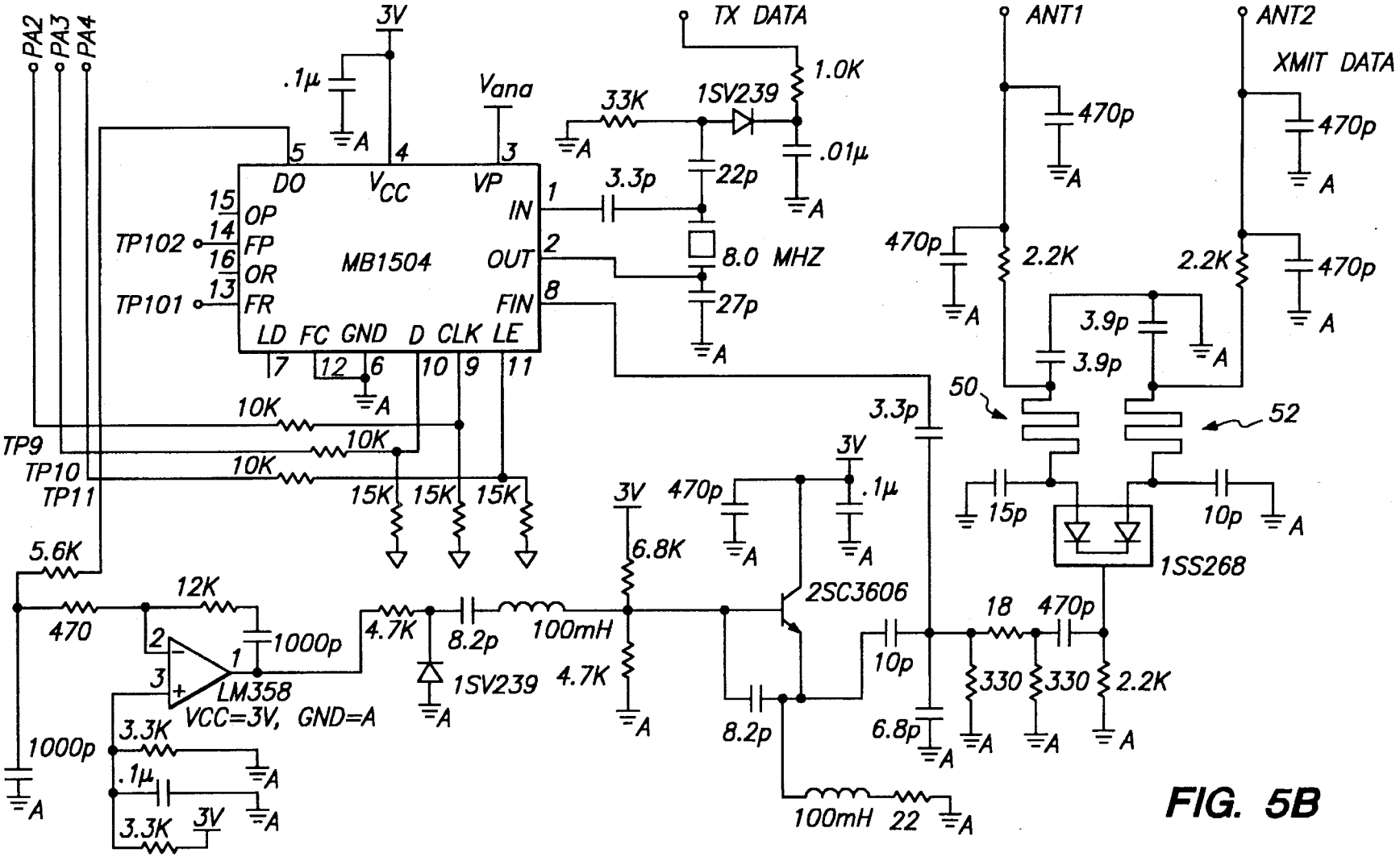
Figure 5C:
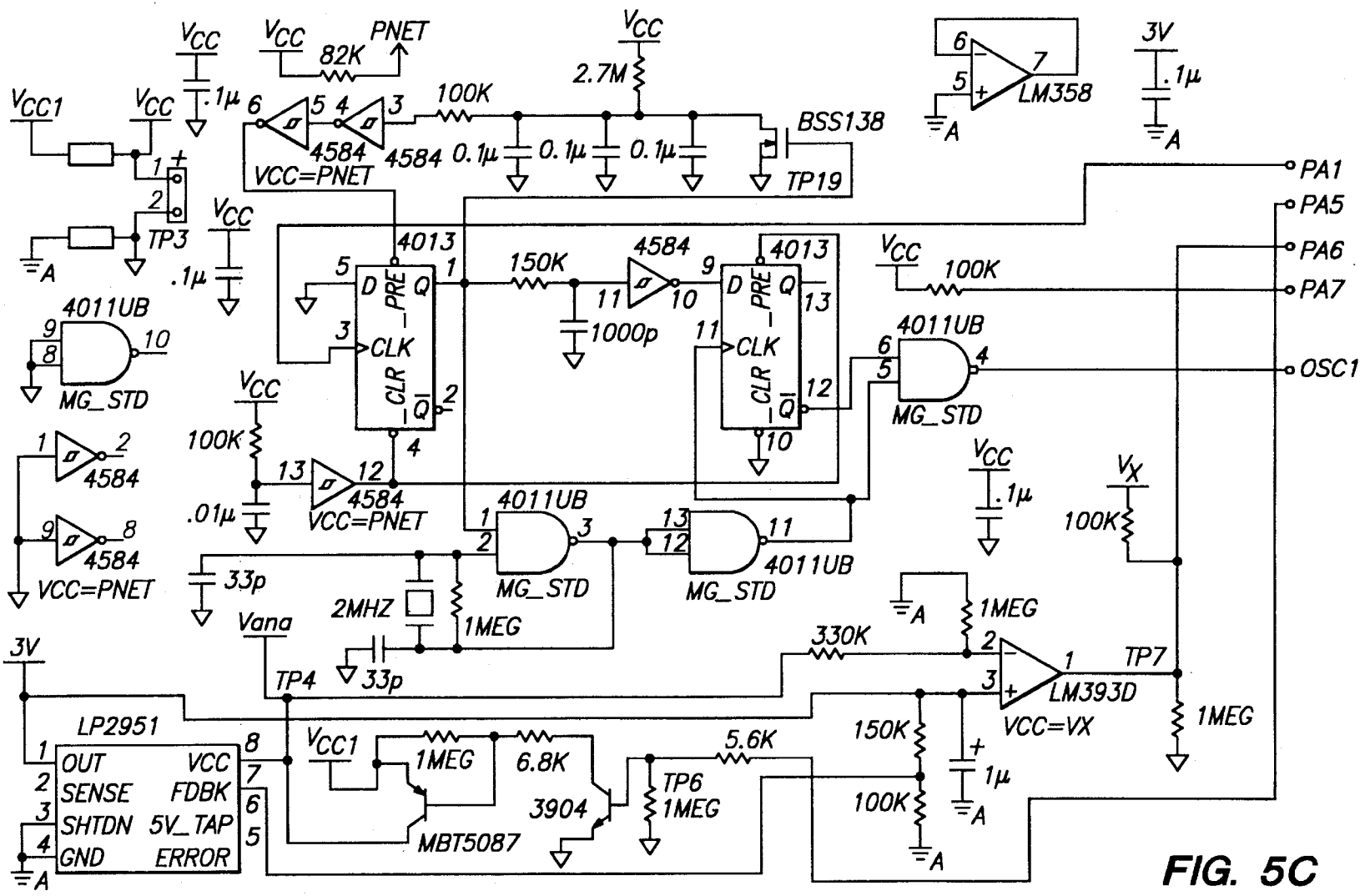

FIGS. 5A–5C are circuit diagrams for the preferred embodiment of a tamper proof bracelet 10 according to the present invention. Identification and values for conventional circuit elements, including IC chips, are provided on these drawings, and the interconnection of same is preferably as shown.

In FIG. 5A, a microprocessor 40, such as the Motorola MC68HC705C8FB microprocessor, controls the transmission of data from the bracelet 10. Tamper status is provided to the microprocessor 40 by the TAMPER DET signal, generated by optical detector 20 as noted below.

The optical emitter 18 includes an LED 42 that is cycled on and off by output PC3 from microprocessor 40. The optical detector 20 includes a photodiode 44 that receives infrared energy from the optical emitter 18 on a duty cycled basis and generates a signal $V_S$. The comparator 46 compares the signal $V_S$ received by the photodiode 44 to a reference signal $V_R$ derived from signal $V_X$ by resistors R34 and R35. If the received signal $V_S$ drops below the reference signal $V_R$, then a tamper condition exists and the state of signal TAMPER DET changes. The microprocessor latches this input and sets a tamper status bit accordingly.

Pins PC0 and PC1 of microprocessor 40 are alternately enabled to drive signals ANT1 and ANT2, respectively. Referring to FIG. 5B, signals ANT1 and ANT2 thus alternately drive data transmissions via first antenna 50 and second antenna 52. The microprocessor 40 is preferably preprogrammed to transmit a predetermined number of data bits in bursts approximately every 20 seconds, including the tamper status bit. Therefore, if a tamper condition of the bracelet 10 is detected, the state of the tamper status bit is changed and the remote receiving station will be alerted to the condition.

The intensity of the light output from the emitter and the sensitivity of the detector should be chosen to allow easy detection of actual tampers while precluding false alarms. Also, the strap should be designed to be easily cut to length without polishing or finishing the ends of the fiber optic cable 26.

In order to conserve transmitter battery life, illumination of the emitter and subsequent sampling of the detector can be done on a duty-cycled basis. In the preferred embodiment, the optical detector 20 is first sampled to verify a "dark" condition signal level. Then, the emitter 18 is turned on for ten microseconds and the optical detector 20 is sampled to verify a "light" condition signal level. Finally, the emitter 18 is turned off. Preferably, this sequence takes place every 500 milliseconds.

A personnel monitoring device has been disclosed which utilizes an optical fiber to enhance the reliability of a tamper detection scheme for the device, thereby virtually eliminating the possibility of by-passing the tamper circuit.

It should be understood that the invention is not intended to be limited by the specifics of the above-described embodiment, but rather defined by the accompanying claims.

We claim:

1. A personnel monitoring apparatus, comprising:

a housing having a pair of slots each having a clear window therein;

a strap having two ends each for coupling to a respective slot;

an optical fiber incorporated with the strap and having two ends each adapted to be optically aligned with respective windows upon coupling of the strap; and a circuit board mounted inside the housing and comprising:

first means for transmitting a data encoded signal comprised of a plurality of data bits;

second means adjacent one of said windows for emitting an optical signal;

third means adjacent the other of said windows for detecting an optical signal;

fourth means for comparing the detected optical signal to a reference signal, wherein a preselected one of said data bits has a value that is dependent on the result of said comparison.

2. A personnel monitoring apparatus according to claim 1, wherein said housing further comprises a pair of clips adjacent each slot, each of said clips having pins thereon which are adapted to insert through the slot, and wherein the strap is fitted with a plurality of holes such that said strap may be secured within said slots by engaging the clips such that the pins are inserted through the holes.

3. A personnel monitoring apparatus, comprising:

a housing having a first slot and a second slot formed therein;

a first window centered in the first slot;

a second window centered in the second slot;

a transmitter affixed inside the housing for generating and transmitting a plurality of data bits;

an optical emitter affixed inside the housing and directed such that an optical signal is emitted through the first window;

an optical detector affixed inside the housing and directed such that the optical signal is detected through the second window;

a strap adapted to be secured inside the first slot and the second slot; and an optical fiber incorporated with the strap for optically coupling the optical emitter to the optical detector;

a comparator coupled to the optical detector and to the transmitter for comparing the optical signal to a reference signal, wherein a preselected one of said data bits has a value that is dependent on the result of said comparison.

4. The personnel monitoring apparatus of claim 3, wherein the housing includes a controller which periodically drives the emitter and samples the detector.

* * * * *